US006715156B1

(12) United States Patent
Purnell

(10) Patent No.: US 6,715,156 B1
(45) Date of Patent: Apr. 6, 2004

(54) REVERSIBLE PROTECTIVE HEADGEAR FOR WRESTLERS

(76) Inventor: John W Purnell, 2908 Chiselford Dr., Sinking Spring, PA (US) 19608

( * ) Notice: Subject to any disclaimer, the term of this patent is extended or adjusted under 35 U.S.C. 154(b) by 0 days.

(21) Appl. No.: 10/338,367

(22) Filed: Jan. 9, 2003

(51) Int. Cl.[7] ..... A63B 71/10
(52) U.S. Cl. ..... 2/425; 2/DIG. 2
(58) Field of Search ..... 2/425, 423, DIG. 2, 2/909, 421, 209

(56) References Cited

U.S. PATENT DOCUMENTS

| | | | | |
|---|---|---|---|---|
| 537,686 A | | 4/1895 | Johnson | |
| 2,277,994 A | | 3/1942 | Roberts | |
| 2,886,818 A | | 5/1959 | Roberts | |
| 2,898,596 A | | 8/1959 | Keen | |
| 3,311,921 A | | 4/1967 | Helm | |
| 3,327,316 A | | 6/1967 | Pukish, Jr. | |
| 3,513,482 A | | 5/1970 | Holden | |
| 3,596,288 A | | 8/1971 | Marchello | |
| 3,714,668 A | * | 2/1973 | Mirabella | 2/909 |
| 4,222,122 A | * | 9/1980 | Toms | 2/425 |
| 4,710,985 A | * | 12/1987 | Dubner et al. | 2/425 |
| 4,821,345 A | | 4/1989 | Marchello | |
| 5,361,420 A | * | 11/1994 | Dobbs et al. | 2/425 |
| 5,504,945 A | | 4/1996 | Purnell | |
| 5,881,393 A | * | 3/1999 | Marchello | 2/425 |
| 6,058,516 A | * | 5/2000 | Purnell | 2/425 |
| 6,088,840 A | * | 7/2000 | Im | 2/DIG. 2 |
| 6,367,090 B1 | * | 4/2002 | Im | 2/425 |

* cited by examiner

*Primary Examiner*—Rodney M. Lindsey
(74) *Attorney, Agent, or Firm*—Sherman & Shalloway

(57) ABSTRACT

This invention relates to a protective headgear for use by wrestlers and other athletes who require protective covers for their ears during practice and contests. The headgear provides shock absorbency and protection for the ears and forehead in an easily adjustable and comfortable device that is also reversible from a first color to a second color and meets the requirements of international wrestling rules as promulgated by the International Federation of Associated Wrestling Styles (FILA).

19 Claims, 4 Drawing Sheets

REVERSIBLE PROTECTIVE HEADGEAR FOR WRESTLERS

FIELD OF THE INVENTION

This invention relates to a protective headgear for use by wrestlers and other athletes who require protective covers for their ears during practice and contests. The headgear provides shock absorbency and protection for the ears in an easily adjustable and comfortable device that is also reversible from a first color to a second color and meets the requirements of international wrestling rules as promulgated by the International Federation of Associated Wrestling Styles (FILA).

BACKGROUND OF THE INVENTION

Amateur wrestlers are subjected to maneuvers and contact with opponents and the wrestling mat which can result in injuries to the outer ear surfaces and to the forehead. Such injuries can be the result of unintentional blows to the ear by opponents, abrasion by sliding contact with the mat, i.e., mat burn, and unintentional head contact between opponents, i.e., head butts. As a means of protecting against such injuries, ear protective devices are in wide-spread use and generally provide a pair of reinforced cup shaped protectors designed to cover the ears and connected by a plurality of generally adjustable straps to form a complete headgear wearable by wrestlers during a match.

Although reinforced protectors are allowed in high school, college and amateur wrestling leagues in the United States, international wrestling rules promulgated by FILA, the International Federation of Associated Wrestling Styles, do not permit the use of any equipment having metal parts or hard, rigid shells. Such reinforced ear protectors as described in the present inventor's prior patents, U.S. Pat. No. 5,504,945 and U.S. Pat. No. 6,058,516 are forbidden in international competition as are ear protectors exemplified by Marchello, U.S. Pat. No. 3,596,288 and U.S. Pat. No. 4,821,345, Dubner, et al., U.S. Pat No. 4,710,985, Keen, U.S. Pat. No. 2,898,596, Johnson U.S. Pat. No. 537,686, Roberts, U.S. Pat. No. 2,277,994 and U.S. Pat. No. 2,886, 818, Helm, U.S. Pat. No. 3,311,921, Pukish, Jr., U.S. Pat. Nos. 3,327,316, and Holden U.S. Pat. No. 3,513,482. Because of this ruling, wrestlers either forego the use of ear protectors and risk injury, or they wear ear protectors that meet the rules but provide insufficient protection. In the case of female wrestlers, the rules require the wearing of conforming ear protectors regardless of the degree of protection provided.

In addition, international rules provide that wrestlers wear either red or blue singlets. The color is assigned to each wrestler by the officials at the match. Thus, if a wrestler decides to wear an ear protector he must have one to match the color assigned to him thereby necessitating the purchase and maintenance of two protectors.

Accordingly, there is a need in International Amateur Wrestling for an ear protector that meets international rules while providing sufficient protection, especially for female wrestlers. It would also be useful if such an ear protector were reversible between a red side and a blue side so that wrestlers would only need to carry one ear protector in their gear.

The present invention addresses these needs in a reversible ear protector that meets the international of non-rigidity, while providing sufficient protection, and that is fully adjustable to accommodate different sized wrestlers.

SUMMARY OF THE INVENTION

The present invention is an improvement over the prior art and provides an ear protector construction resulting in better protection to both the wearer and his opponent and which provides a degree of shock absorbency not found in similar devices. In addition, the invention provides a protective ear guard assembly that is fully adjustable for optimum comfort and protection as well as being reversible from a first color to a second color. Furthermore, the ear protector has a construction that meets international rules.

The present invention provides a reversible protective headgear for wrestlers comprising;

a left side ear protector, a right side ear protector, and a forehead protector, wherein the protectors have a first color on one side and a second color on the other side and the protectors and headgear are reversible from a first condition with the first color outermost to a second condition with the second color outermost The present invention further provides a reversible protective headgear for wrestlers wherein the ear protectors have ear cups of a flexibly resilient polymer that provides protection to the outer ear without rigidity and is deformable so as to facilitate reversibility of the headgear from a first color to a second color.

The present invention still further provides a reversible protective headgear for wrestlers comprising;

a first ear protector comprising an ear cup of a size to fit over a human ear and receive the exposed auricle thereof, the ear cup comprising a sheet of flexibly resilient polymer formed into a cupped structure and confined between two sheets of partially compressed foam, at least one crown strap extending from an upper peripheral edge of the ear cup, and at least one occipital strap extending from a rear edge of the ear cup, each strap having releasable connection means, a second ear protector comprising an ear cup of a size to fit over a human ear and receive the exposed auricle thereof, the ear cup comprising a sheet of flexibly resilient polymer formed into a cupped structure and confined between two sheets of partially compressed foam, at least one crown strap extending from an upper peripheral edge of the ear cup, and at least one occipital strap extending from a rear edge of the ear cup, each strap having releasable connection means, an adjustable and releasable chin strap extending between lower peripheral edges of the ear cups and having a length sufficient to traverse the chin of a user, an adjustable and releasable forehead strap extending between upper forward edges of the ear cups and having a length sufficient to traverse the forehead of a user, the ear protectors having a first color on one side and a second color on the other side, whereby the releasable connection means are co-operable to connect the first and second ear protectors into a structure to fit on the human head such that the ear cups fit over and receive a user's ears and whereby the ear protectors are reversible, the ear cups being deformable from a first position with the first color outermost to a second position with the second color outermost Thus, it is an object of this invention to provide an improved protective headgear for wrestlers.

It is a further object to provide an improved protective headgear that meets international regulations while providing a degree of shock absorbency and ease of adjustment.

It is a still further object to provide an improved protective headgear that is easily reversible from one color to another color.

Further objects and advantages will become evident from the following drawings and descriptions.

DETAILED DESCRIPTION OF THE INVENTION

Figure 1:
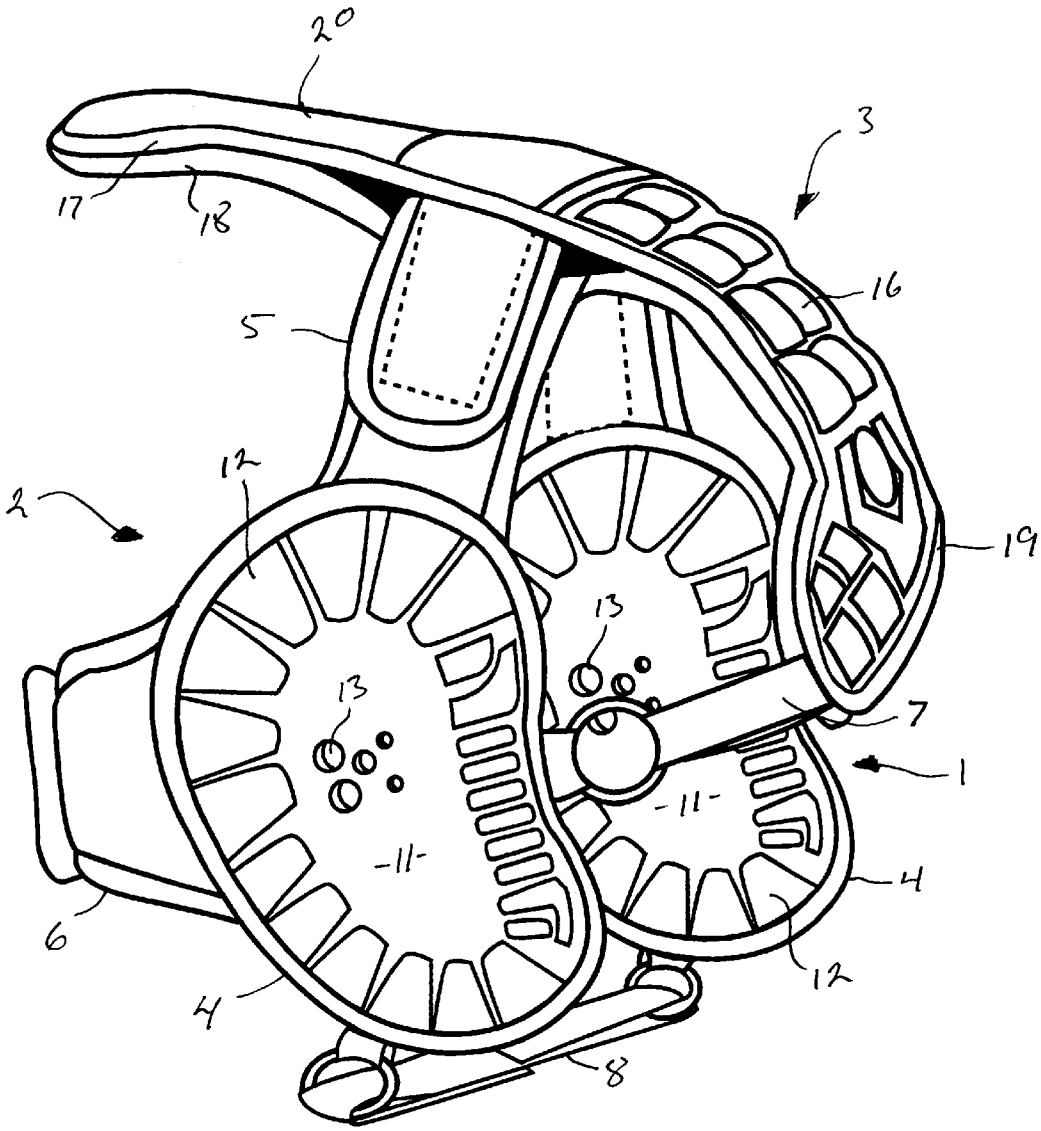
FIG. 1. is a front oblique view of the complete headgear assembly according to the present invention.
Figure 2:
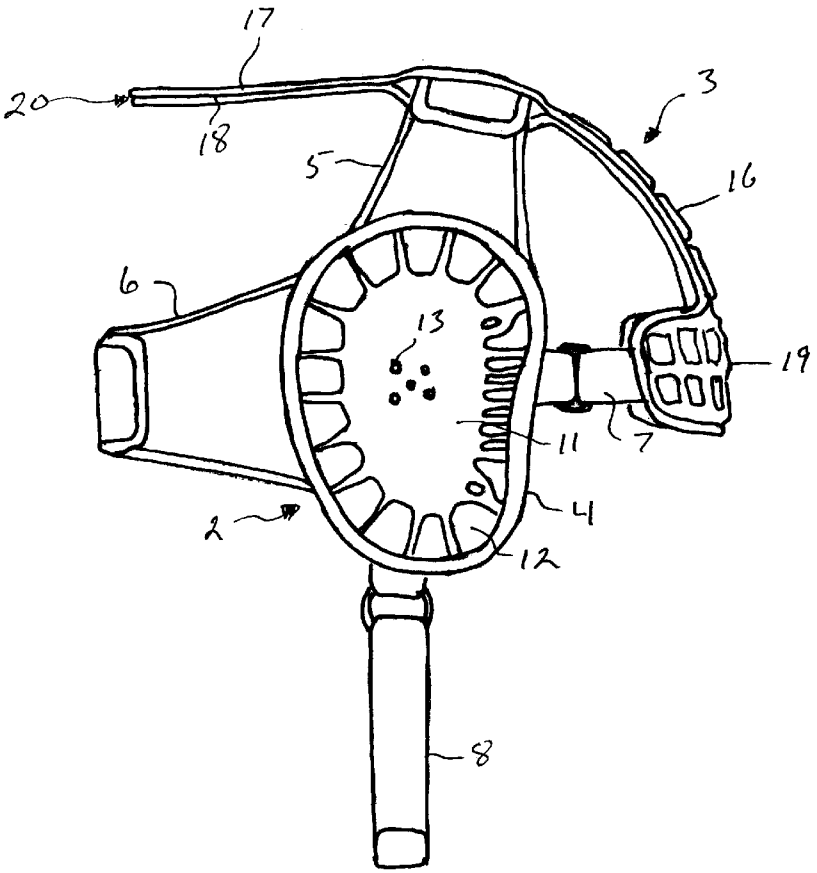
FIG. 2. is a side view of the complete headgear assembly according to the present invention.
Figure 3:
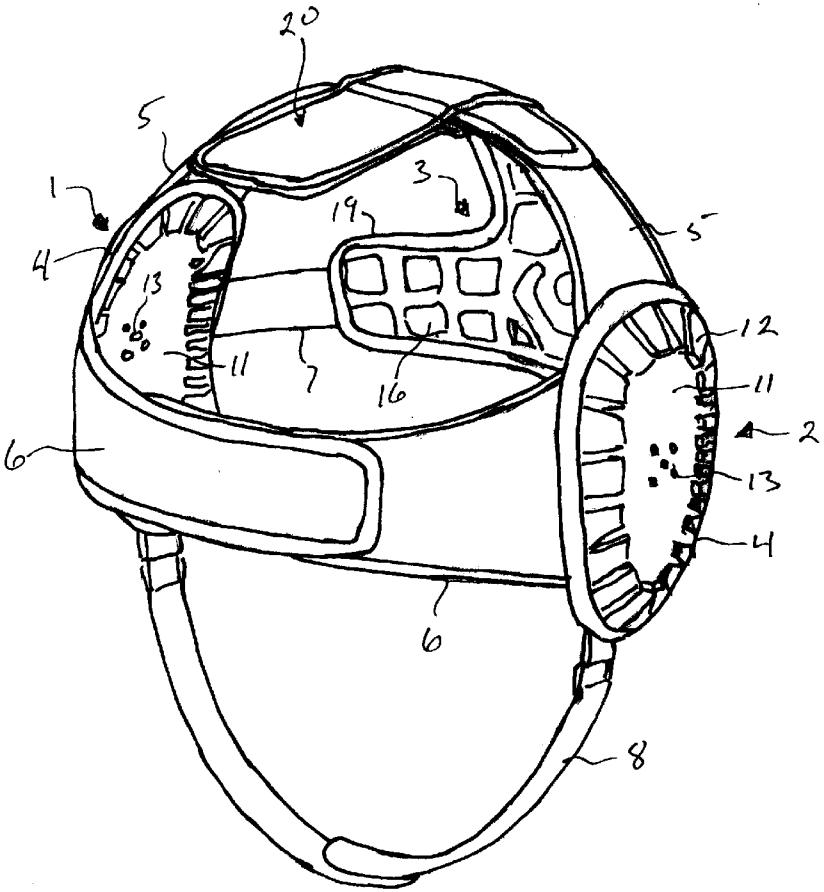
FIG. 3. is a rear oblique view of the complete headgear assembly according to the present invention.

FIGS. 1–3 illustrate the reversible protective headgear of the present invention in fully assembled form. The headgear has three main parts, left and right ear protectors 1 and 2, and a forehead protector 3. Ear protectors 1 and 2 are substantially identical and mirror images of each other and comprise an ear cup 4, a crown strap 5 extending from an upper peripheral edge of the ear cup 4, and an occipital strap 6 extending from a rear peripheral edge of the ear cup 4. The crown straps 5 connect the ear protectors 1 and 2 across the top of the head while the occipital straps 6 pass around and connect at the back of the head. Crown straps 5 and occipital straps 6 are each provided with cooperating releasable and adjustable connecting means, such as Velcro® type fastener material. A forehead strap 7 connects the ear cups 4 across the wearer's forehead and passes through the forehead protector 3 in a manner to be described. The forehead strap 7 is adjustable and releasable by means of similar connecting means. Also, a chin strap 8 is provided to hold the assembly in place on the wearer's head and may include a chin cup (not shown).

Left and right ear protectors 1 and 2 and forehead protector 3 are preferably provided with different colors on each side. Inasmuch as international wrestling rules provide that competitors wear either red or blue, the preferred colors are red on one side and blue on the other. However, other colors may be used without departing from the scope of the present invention. This two color arrangement is facilitated by the preferred construction of the headgear.

Figure 4:
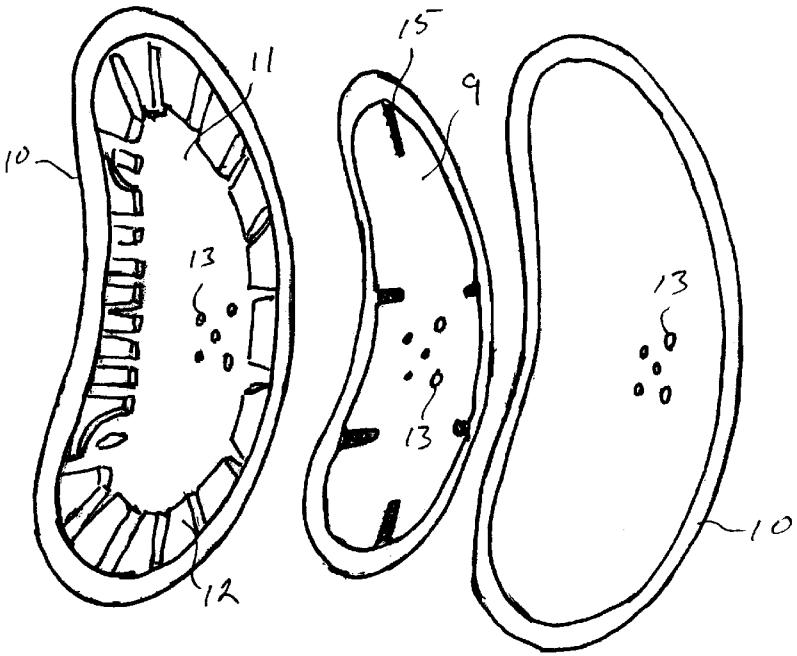
FIG. 4. is an exploded view of an ear cup of the headgear according to the present invention.

As shown in FIG. 4, the ear cups 4 consist of an inner cup 9 made from a flexibly resilient polymer. International rules prohibit rigid ear cups, accordingly, the cup 9 has sufficient rigidity to provide structure but not so much as to prevent the ear cup 4 from flexing when subjected to pressure. This flexible resilience is a function in part of the material and its thickness and of the manner in which it is formed into the cup 9. Preferred materials are polypropylene, polyethylene, polyester and polyvinyl chloride, although other polymers that can provide the combination of resilience and flexibility may certainly be used. In order to achieve the necessary structure, resilience and flexibility, the thickness of the polymer sheet from which the cup 9 is formed is preferably between 0.5 mm and 1.2 mm. Less than 0.5 mm and the cup does not have sufficient strength to maintain its shape, while more than 1.2 mm and the cup becomes too rigid to flex suitably so as to permit it to be selectively deformed when the headgear is reversed.

To provide cushioning to the ear, cup 9 is sandwiched between two sheets of foam 10, preferably EVA foam. Cup 9 may be embedded in the foam or the edges of the foam sheets 10 may be bound to enclose the cup 9. In keeping with the two color appearance of the headgear, the foam sheets 10 are each a different color corresponding to the colors chosen for the particular headgear. The foam sheets 10 may be a single thickness but to provide increased comfort and better shock absorbancy, the foam is preferably partially compressed over the center portion 11 of the ear cup 4 and uncompressed about the periphery 12. The uncompressed periphery 12 provides cushioning around the ear while the compressed center portion 11 provide room for the outer ear. Vent holes 13 are provided to avoid air compression within the ear canal.

Figure 5:
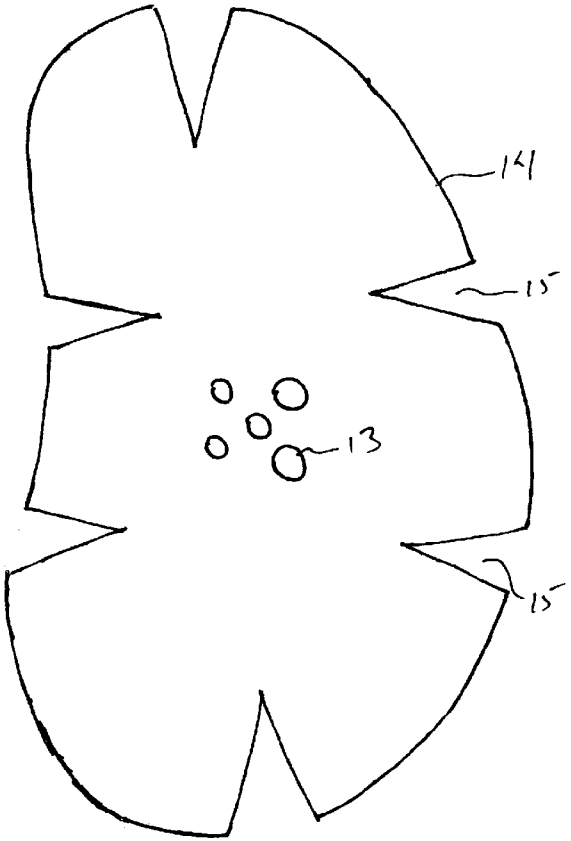
FIG. 5. is a plan view of a blank for forming the cupped structure of an ear cup of the headgear according to the present invention.

As noted previously cup 9 is formed from a sheet of polymer material. This may be done by an actual molding process. However, preferably cup 9 is formed from a flat blank 14 as shown in FIG. 5. Blank 14 is cut from a sheet of polymer in an ovoid shape substantially conforming to the shape of an ear. A plurality of notches 15 are cut into the periphery of the blank 14. Preferably six notches 15, two in the forward edge, two in the rear edge and one each at the upper and lower edges. More or fewer than six notches may be used, but six are preferred to achieve an even cup shape. The adjacent edges of the notches 15 are drawn together and secured, such as by stitching or such other means that will secure these edges in a substantially permanent manner. Alternatively, where it will not result in excessive thickness to the polymer sheet thereby rendering it too rigid to flex and deform, instead of notches 15, simple slits may be cut with a small circular terminus and the edges of these slits pulled into an overlapping arrangement and secured, thereby imparting a cup shape to the polymer blank 14.

Figure 6:
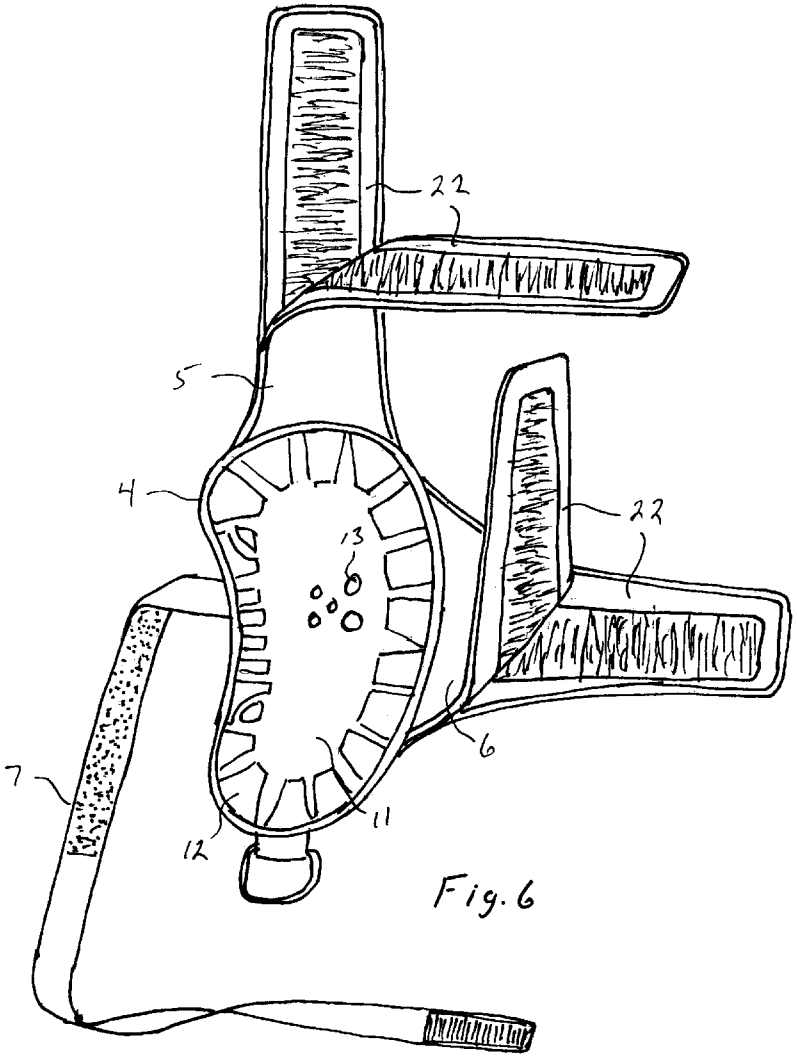
FIG. 6. is a view of the preferred form of one ear protector of the headgear according to the present invention.

As noted previously, cup 9 is sandwiched between two sheets of foam 10. Preferably the edges of the foam are bound to provide protection and to prevent tearing and the two sheets 10 are then secured together with the cup 9 therebetween. Simultaneously, crown straps 5 and occipital straps 6 are attached to the ear cups 4. Crown straps 5 and occipital straps 6 may be made from any suitable material and are provided in the appropriate colors on each side. In one form, crown strap 5 and occipital strap 6 of the ear protectors 1 and 2 are each made from two identical pieces of felt strapping in different colors that are bound together around their periphery in a face to face arrangement. The hook portion of a hook and loop fastener is secured to one of the cooperating straps and provides releasable and adjustable fastening means. In a preferred form, the crown strap 5 and occipital strap 6 of one of the ear protectors 1 or 2 is made in this manner only without the fastener. The corresponding crown strap 5 and occipital strap 6 of the other ear protector 1 or 2 are formed as shown in FIG. 6, with the individual face to face strapping pieces bound together only where they are secured to ear cup 4. The hook portion of a hook and loop fastener is provided on the facing surfaces 22 of the strapping pieces. In this manner, the crown strap 5 of the first ear protector is received between the facing surfaces 22 of the crown strap 5 of the second ear protector and held in place by the fastening means. Similarly, the occipital strap 6 of the first ear protector is received between the facing surfaces 22 of the occipital strap 6 of the second ear protector and is held in place by the fastening means thereon. In this preferred embodiment, the separable crown and occipital straps 5 and 6 of the second ear protector may be made from compressed EVA foam thereby providing cushioning to the top and rear of the user's head.

Figure 7:
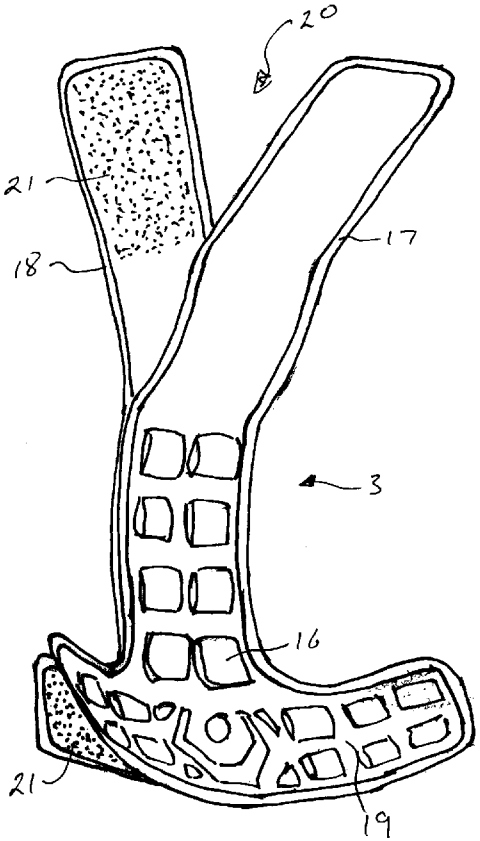
FIG. 7. is a view of the preferred form of the forehead protector of the headgear according to the present invention.

The headgear is assembled by connecting the crown straps 5 and occipital straps 6 of the left and right ear protectors 1 and 2, adjusting them for a proper fit. At the same time, forehead strap 7 and chin strap 8 are also adjusted for a proper fit. Although the headgear can be used in this form, it is preferred that the forehead protector 3 also be assembled to the headgear thereby providing cushioning for the forehead strap 7 and protection to the user's forehead from inadvertent contact with an opponent and/or the mat. As shown in FIG. 7, forehead protector 3 is substantially T-shaped and is preferably formed from partially compressed EVA foam with the edges bound for protection and to prevent tearing. As with the ear cups 4, uncompressed areas 16 of the foam provide shock absorbency and cushioning to the forehead of the user as well as providing for better conformance to the shape of the wearer's head.

Preferably, forehead protector 3 is made from two identical T-shaped pieces 17 and 18 arranged one over the other and stitched or otherwise joined together in the area adjacent to the cross bar 19 of the T. Releasable fastening means 21, such as hook and loop type fasteners, are provided on the inner surfaces of the T-shaped pieces 17 and 18 at the lower end 20 of the T and along the cross bar 19. In this manner the protector 3 is formed, as shown in FIG. 6, with the cross bar of the T and the lower end 20 of the T separable. This separable relationship permits the forehead protector 3 to be assembled to the headgear as shown in FIGS. 1, 2 and 3 with the crown straps 5 placed between the lower ends 20 of T-shaped pieces 17 and 18, the releasable fastening means 21 holding the lower ends 20 together. Similarly, forehead strap 7 fits between the cross bars 19 of T-shaped pieces 17 and 18, which are likewise held together by releasable fastening means 21.

T-shaped pieces 17 and 18 are each preferably provided in different colors corresponding to those used for left and right ear protectors 1 and 2. This is clearly facilitated by the two piece construction of forehead protector 3. Furthermore, the overall construction of the headgear renders it easily and readily adjustable for different sizes of wrestlers and its lightweight renders it suitable for all wrestlers in any weight division. Finally, because the ear cups are constructed in the manner described, they provide protection while not violating the international rule against the use of equipment having hard or rigid shells and are reversible simply by deforming the ear cup so that it snaps from a first cupped direction with a first color outermost to a second cupped direction with a second color outermost. In this manner, a wrestler need only carry one headgear and can easily change it from one color to another upon notification by the wrestling officials as to which of two colors he must use.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A reversible protective headgear for wrestlers comprising;

a left side ear protector, a right side ear protector, and a forehead protector, said protectors having a first color on one side and a second color on the other side and being reversible from a first condition with said first color outermost to a second condition with said second color outermost and wherein said ear protectors and said forehead protector are releasably connected to form said headgear and further comprising an adjustable and releasable chin strap between said left and right side ear protectors.

2. The headgear of claim 1 wherein said ear protectors each comprise an ear cup comprising a sheet of flexibly resilient polymer formed into a cupped structure capable of receiving a user's ear, confined between two sheets of cushioning foam.

3. The headgear of claim 2 wherein said polymer sheet has a thickness of from 0.5 mm to 1.2 mm.

4. The headgear of claim 3 wherein said polymer sheet is selected from the group consisting of polypropylene, polyethylene, polyester, and polyvinyl chloride.

5. The headgear of claim 2 wherein the foam is ethylene vinyl acetate and is partially compressed in a pattern providing uncompressed areas about a perimeter whereby cushioning protection to the ear is provided.

6. The headgear of claim 4 wherein said polymer sheet is formed into a cupped structure by molding.

7. The headgear of claim 4 wherein said polymer sheet is formed into a cupped shape by first cutting a plurality of V-shaped notches in the periphery of said sheet then drawing adjoining edges of said notches together and securing them whereby said sheet takes on a cupped structure having sufficient flexibility to permit deformation to reverse the direction of the cup.

8. The headgear of claim 2 wherein each ear protector further comprises at least one crown strap extending from an upper edge of said ear cup and at least one occipital strap extending from a rear edge of said ear cup, each strap having releasable connection means whereby said straps of said left side ear protector are releasably connectable to said right side ear protector.

9. The headgear of claim 8 further comprising a forehead strap extending from an upper forward edge of one of said ear cups and a ring flexibly secured to a corresponding upper forward edge of the other of said ear cups, said forehead strap having a length sufficient to traverse a user's forehead when said ear cups are positioned over the user's ears, to pass through said ring and to fold back over and releasably secure to itself.

10. The headgear of claim 9 wherein said forehead protector comprises a substantially T-shaped structure of partially compressed foam wherein the horizontal cross bar of said T is capable of releasably receiving and cushioning said forehead strap and the vertical tail of said T is capable of releasably receiving said crown straps of said ear protectors.

11. The headgear of claim 10 wherein said forehead protector further comprises first and second substantially T-shaped structures in planar relationship to each other and secured together along a portion of said vertical tail adjacent to said horizontal cross bar, said first and second structures being separable along said horizontal cross bar to receive said forehead strap, and along said vertical tail to receive said crown straps therebetween, said first and second structures having releasable securing means along said cross bar and said tail to releasably secure said structures about said forehead strap and said crown straps.

12. A reversible protective headgear for wrestlers comprising;

a first ear protector comprising an ear cup of a size to fit over a human ear and receive the exposed auricle thereof, said ear cup comprising a sheet of flexibly resilient polymer formed into a cupped structure and confined between two sheets of partially compressed foam, at least one crown strap extending from an upper peripheral edge of said ear cup, and at least one occipital strap extending from a rear edge of said ear cup, each a strap having releasable connection means, a second ear protector comprising an ear cup of a size to fit over a human ear and receive the exposed auricle thereof, said ear cup comprising a sheet of flexibly resilient polymer formed into a cupped structure and confined between two sheets of partially compressed foam, at least one crown strap extending from an upper peripheral edge of said ear cup, and at least one occipital strap extending from a rear edge of said ear cup, each strap having releasable connection means, an adjustable and releasable chin strap extending between lower peripheral edges of said ear cups and having a length sufficient to traverse the chin of a user, an adjustable and releasable forehead strap extending between upper forward edges of said ear cups and having a length sufficient to traverse the forehead of a user, said ear protectors having a first color on one side and a second color on the other side, whereby said releasable connection means are cooperable to connect crown straps and said occipital straps of said first and second ear protectors into a structure to fit on the human head such that said ear cups fit over and receive a user's ears and whereby said ear protectors are reversible, said ear cups being deformable from a first position with said first color outermost to a second position with said second color outermost.

13. The headgear of claim 12 further comprising a forehead protector comprising a substantially T-shaped structure of partially compressed foam, wherein the horizontal cross bar of said T is capable of releasably receiving and cushioning said forehead strap, the vertical tail of said T is capable of releasably receiving said crown straps, said forehead protector having said first color on one side and said second color on the other side and being reversible with said first and second ear protectors.

14. The headgear of claim 13 wherein said crown strap of said first ear protector comprises two identical straps in face to face arrangement adapted to receive the crown strap of said second ear protector therebetween and having releasable connection means on the facing surfaces thereof cooperable with said crown strap of said second ear protector.

15. The headgear of claim 13 wherein said occipital strap of said first ear protector comprises two identical straps in face to face arrangement adapted to receive the occipital strap of said second ear protector therebetween and having releasable connection means on the facing surfaces thereof cooperable with said occipital strap of said second ear protector.

16. The headgear of claim 13 wherein said sheet of flexibly resilient polymer has a thickness of from 0.5 mm to 1.2 mm.

17. The headgear of claim 16 wherein said polymer is selected from the group consisting of polypropylene, polyethylene, polyester, and polyvinyl chloride.

18. The headgear of claim 17 wherein said polymer is formed into said cupped structure by molding.

19. The headgear of claim 17 wherein said ear cup further comprises said cupped structure formed from a blank of said polymer sheet in which a plurality of notches are cut about the periphery thereof, adjacent edges of said notches being drawn together and secured, whereby said blank is caused to take on a cupped structure, and whereby said cupped structure has sufficient flexibility to permit deformation to reverse the direction of the cup.

* * * * *